US010771904B2

(12) United States Patent
Schultz

(10) Patent No.: US 10,771,904 B2
(45) Date of Patent: Sep. 8, 2020

(54) DIRECTIONAL MEMS MICROPHONE WITH CORRECTION CIRCUITRY

(71) Applicant: Shure Acquisition Holdings, Inc., Niles, IL (US)

(72) Inventor: Jordan Schultz, Chicago, IL (US)

(73) Assignee: Shure Acquisition Holdings, Inc., Niles, IL (US)

( * ) Notice: Subject to any disclaimer, the term of this patent is extended or adjusted under 35 U.S.C. 154(b) by 0 days.

(21) Appl. No.: 16/254,754

(22) Filed: Jan. 23, 2019

(65) Prior Publication Data

US 2019/0230446 A1 Jul. 25, 2019

Related U.S. Application Data

(60) Provisional application No. 62/621,406, filed on Jan. 24, 2018.

(51) Int. Cl.
*H04R 19/04* (2006.01)
*H04R 1/04* (2006.01)
(Continued)

(52) U.S. Cl.
CPC ..... *H04R 19/04* (2013.01); *H04R 1/04* (2013.01); *H04R 3/04* (2013.01); *H04R 3/06* (2013.01);
(Continued)

(58) Field of Classification Search
CPC .... H04R 3/04; H04R 2201/003; H04R 3/007; H04R 19/005; H04R 19/04; H04R 1/04;
(Continued)

(56) References Cited

U.S. PATENT DOCUMENTS 5,949,892 A 9/1999 Stewart
6,075,869 A * 6/2000 Killion ..... H04R 1/406 381/313
(Continued)

FOREIGN PATENT DOCUMENTS

CN 203933949 11/2014
CN 205249484 5/2016
(Continued)

OTHER PUBLICATIONS

Geiser, et al., "A Differential Microphone Array with Input Level Alignment, Directional Equilization and Fast Notch Adaptation for Handsfree Communication," Speech Communication, Sep. 2014, 4 pp.
(Continued)

*Primary Examiner* — Lun-See Lao
(74) *Attorney, Agent, or Firm* — Neal, Gerber & Eisenberg LLP

(57) ABSTRACT

A microphone assembly is provided, comprising a transducer assembly including a first enclosure defining a first acoustic volume and a Micro-Electrical-Mechanical-System ("MEMS") microphone transducer disposed within the first enclosure. The microphone assembly also includes a second enclosure disposed adjacent to the first enclosure and defining a second acoustic volume in acoustic communication with the first acoustic volume, the second enclosure including an acoustic resistance, wherein the first and second acoustic volumes, in cooperation with the acoustic resistance, create an acoustic delay for producing a directional polar pattern. Circuitry comprising a shelving filter configured to correct a portion of a frequency response of the MEMS microphone transducer is also provided. In some embodiments, the circuitry is embedded within the transducer assembly or at least included within the microphone assembly. In other embodiments, the circuitry is located on
(Continued)

a cable that is electrically connected to a connection port of the microphone assembly.

20 Claims, 5 Drawing Sheets

(51) Int. Cl.
*H04R 3/04* (2006.01)
*H04R 19/00* (2006.01)
*H04R 3/06* (2006.01)
*H04R 1/38* (2006.01)

(52) U.S. Cl.
CPC ..... *H04R 19/005* (2013.01); *H04R 1/38* (2013.01); *H04R 2201/003* (2013.01)

(58) Field of Classification Search
CPC ..... H04R 1/1041; H04R 1/1083; H04R 1/22; H04R 1/38; H04R 2420/07; H04R 29/004; H04R 29/005; H04R 3/06; H04R 1/1008; H04R 1/2826; H04R 1/406; H04R 2410/05; H04R 2430/20; H04R 2460/05; H04R 2499/11; H04R 2499/13; H04R 25/305; H04R 3/005; H04R 2203/12; H04R 2225/43; H04R 2410/01; H04R 2430/01; H04R 25/43; H04R 25/48; H04R 25/75; A61F 11/14; A61F 2011/145; A61F 11/00; A61F 2250/0002; G10K 11/178; G10K 11/17881; G10K 11/17885; G10K 2210/1081; H03G 3/3005; H03G 5/165; H03G 9/025; H04B 3/23; G10L 21/0232
USPC ..... 381/98, 92, 175, 355, 150, 369
See application file for complete search history.

(56) References Cited

U.S. PATENT DOCUMENTS

| | | | | |
|---|---|---|---|---|
| 7,146,014 | B2 | 12/2006 | Hannah | |
| 7,269,266 | B2 | 9/2007 | Anjanappa | |
| 7,933,428 | B2 | 4/2011 | Sawada | |
| 8,184,845 | B2 * | 5/2012 | Leidl | B81B 7/0061 257/416 |
| 8,259,959 | B2 | 9/2012 | Marton | |
| 9,084,057 | B2 | 7/2015 | Turqueti | |
| 9,161,125 | B2 | 10/2015 | Nystrom | |
| 9,301,033 | B2 | 3/2016 | Han | |
| 9,319,765 | B2 | 4/2016 | Ravnkilde | |
| 2006/0088176 | A1 | 4/2006 | Werner, Jr. | |
| 2014/0103464 | A1 | 4/2014 | Bolognia | |
| 2014/0264652 | A1 | 9/2014 | Cagdaser | |
| 2015/0141774 | A1 | 5/2015 | Ogawa | |
| 2016/0007107 | A1 * | 1/2016 | Reese | H04R 19/005 381/174 |
| 2016/0150319 | A1 | 5/2016 | Yoo | |
| 2016/0165361 | A1 * | 6/2016 | Miller | H04R 25/43 381/317 |
| 2016/0241953 | A1 | 8/2016 | Elian | |

FOREIGN PATENT DOCUMENTS

| | | |
|---|---|---|
| EP | 2822298 | 1/2015 |
| EP | 2963946 | 1/2016 |
| JP | 2016184794 | 10/2016 |
| KR | 20140121623 | 10/2014 |
| KR | 101493335 | 2/2015 |
| TW | I232063 | 5/2005 |
| WO | 2000049836 | 8/2000 |
| WO | 2007032582 | 3/2007 |
| WO | 2011056856 | 5/2011 |

OTHER PUBLICATIONS

International Search Report and Written Opinion for PCT/US2019/014660 dated Apr. 10, 2019, 12 pp.

* cited by examiner

DIRECTIONAL MEMS MICROPHONE WITH CORRECTION CIRCUITRY

CROSS-REFERENCE

This application claims priority to U.S. Provisional Patent Application No. 62/621,406, filed Jan. 24, 2018, the content of which is fully incorporated herein by reference.

TECHNICAL FIELD

This application generally relates to MEMS (Micro-Electrical-Mechanical-System) microphones. In particular, this application relates to a directional MEMS microphone with circuitry for correcting a frequency response of the microphone.

BACKGROUND

There are several types of microphones and related transducers, such as for example, dynamic, crystal, condenser/capacitor (externally biased and electret), etc., which can be designed with various polar response patterns (cardioid, supercardioid, omnidirectional, etc.). Each type of microphone has its advantages and disadvantages depending on the application.

Micro-Electrical-Mechanical-System ("MEMS") microphones, or microphones that have a MEMS element as the core transducer, have become increasingly popular due to their small package size and high performance characteristics (e.g., high signal-to-noise ratio ("SNR"), low power consumption, good sensitivity, etc.). However, due to the physical constraints of the microphone packaging, the polar pattern of a conventional MEMS microphone is inherently omnidirectional, which can be less than ideal for wideband applications, such as, e.g., recording studios, live performances, etc.

More specifically, MEMS microphones effectively operate as "pressure microphones" by producing an output voltage proportional to the instantaneous air pressure level at the transducer location. For example, MEMS microphone transducers typically include a moving diaphragm positioned between a sound inlet located at a front end of the transducer for receiving incoming sound waves and a rear acoustic chamber that has a fixed volume of air and is formed by a housing covering a back end of the transducer. Changes in air pressure level due to incoming sound waves cause movement of the diaphragm relative to a perforated backplate also included in the transducer. This movement creates a capacitance change between the diaphragm and the backplate, which creates an alternating output voltage which is sensed by an integrated circuit (e.g., Application Specific Integrated Circuit ("ASIC")) included in the microphone package. As will be appreciated, because the housing (e.g., enclosure can) covers the back end of the MEMS transducer, it blocks rear acoustic access to the moving diaphragm of the MEMS transducer. As a result, the MEMS microphone receives sound only through the sound inlet at the front end of the transducer, thus creating an omnidirectional response.

Accordingly, there is a need for a MEMS microphone with a directional polar pattern that can be isolated from unwanted ambient sounds and is suitable for wideband audio and professional applications.

SUMMARY

The invention is intended to solve the above-noted and other problems by providing a MEMS microphone with, among other things, (1) an internal acoustic delay network configured to produce a directional polar pattern, the acoustic delay network comprising a large cavity compliance formed by adding a second enclosure can behind the existing enclosure can of the MEMS transducer and an acoustic resistance coupled to a rear wall of the second enclosure can; and (2) correction circuitry for creating a microphone frequency response that is appropriate for use in wideband audio (e.g., 20 Hz to 20 kHz).

For example, one embodiment includes a microphone assembly comprising a transducer assembly including a first enclosure defining a first acoustic volume and a Micro-Electrical-Mechanical-System ("MEMS") microphone transducer disposed within the first enclosure; a second enclosure disposed adjacent to the first enclosure and defining a second acoustic volume in acoustic communication with the first acoustic volume, the second enclosure including an acoustic resistance, wherein the first and second acoustic volumes, in cooperation with the acoustic resistance, create an acoustic delay for producing a directional polar pattern for the MEMS microphone transducer; and circuitry electrically coupled to the transducer assembly and comprising a shelving filter configured to correct a portion of a frequency response of the MEMS microphone transducer.

Another example embodiment includes a microphone assembly comprising a transducer assembly including a Micro-Electrical-Mechanical-System ("MEMS") microphone transducer, an integrated circuit electrically coupled to the MEMS microphone transducer, and a first enclosure defining a first acoustic volume and having disposed therein the integrated circuit and the MEMS microphone transducer; and a second enclosure disposed adjacent to the first enclosure and defining a second acoustic volume in acoustic communication with the first acoustic volume, the first and second acoustic volumes creating an acoustic delay to produce a directional polar pattern for the MEMS microphone transducer, wherein the integrated circuit includes circuitry comprising a shelving filter configured to correct a portion of a frequency response of the MEMS microphone transducer.

These and other embodiments, and various permutations and aspects, will become apparent and be more fully understood from the following detailed description and accompanying drawings, which set forth illustrative embodiments that are indicative of the various ways in which the principles of the invention may be employed.

DETAILED DESCRIPTION

Figure 1:
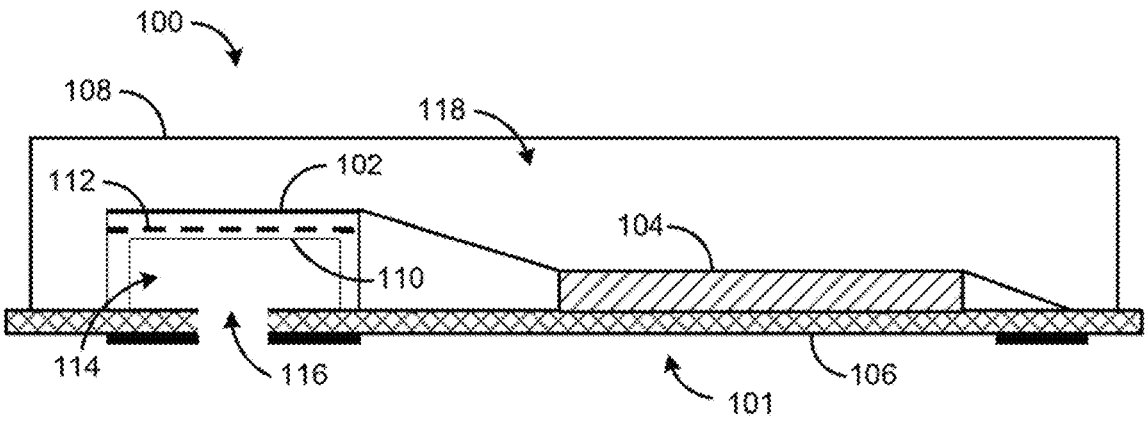
FIG. 1 (PRIOR ART)
FIG. 1 is a schematic diagram illustrating general topology of a conventional omnidirectional MEMS microphone.

The description that follows describes, illustrates and exemplifies one or more particular embodiments of the invention in accordance with its principles. This description is not provided to limit the invention to the embodiments described herein, but rather to explain and teach the principles of the invention in such a way to enable one of ordinary skill in the art to understand these principles and, with that understanding, be able to apply them to practice not only the embodiments described herein, but also other embodiments that may come to mind in accordance with these principles. The scope of the invention is intended to cover all such embodiments that may fall within the scope of the appended claims, either literally or under the doctrine of equivalents.

It should be noted that in the description and drawings, like or substantially similar elements may be labeled with the same reference numerals. However, sometimes these elements may be labeled with differing numbers, such as, for example, in cases where such labeling facilitates a more clear description. Additionally, the drawings set forth herein are not necessarily drawn to scale, and in some instances proportions may have been exaggerated to more clearly depict certain features. Such labeling and drawing practices do not necessarily implicate an underlying substantive purpose. As stated above, the specification is intended to be taken as a whole and interpreted in accordance with the principles of the invention as taught herein and understood to one of ordinary skill in the art.

Figure 2:
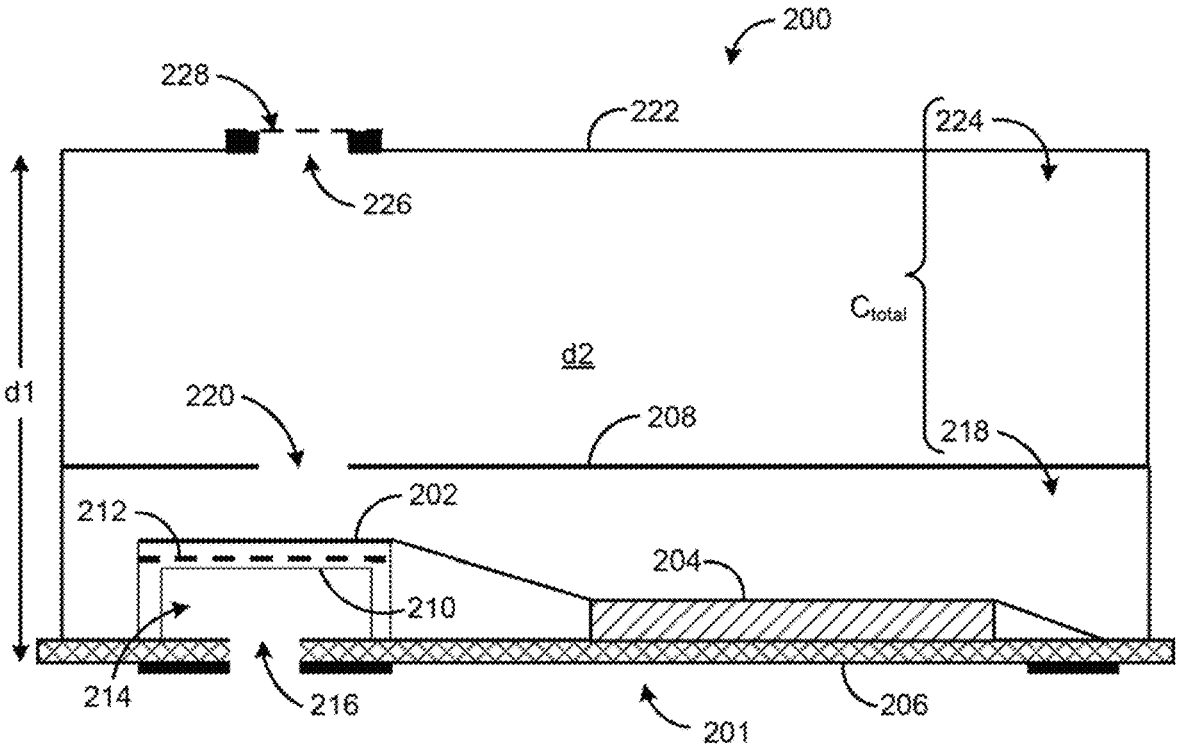
FIG. 2 is a schematic diagram illustrating general topology of an example directional MEMS microphone in accordance one or more embodiments.

FIG. 1 illustrates the general topology of a typical or conventional analog MEMS microphone 100, which is shown for comparison to the general topology of directional MEMS microphone 200 designed in accordance with the techniques described herein and shown in FIG. 2. The MEMS microphone 100 includes a conventional transducer assembly 101 comprised of a MEMS sensor or transducer 102 electrically coupled to an integrated circuit 104, both of which are formed on a substrate 106 (e.g., silicon wafer) and encased within a housing 108 (e.g., enclosure can). The integrated circuit 106 is typically an Application Specific Integrated Circuit ("ASIC") configured to operatively couple the MEMS transducer 102 to a printed circuit board ("PCB") and other external devices.

The MEMS transducer 102 essentially functions as a silicon capacitor comprised of a moveable membrane or diaphragm 110 and a fixed backplate 112. More specifically, the diaphragm 110 is behind a front chamber or cavity 114 formed within the transducer 102, and the backplate 112 is positioned behind the diaphragm 110, adjacent to a back chamber 118 formed around a rear of the transducer 102 by the enclosure can 108. The moveable diaphragm 110 is a thin, solid structure that flexes in response to a change in air pressure caused by sound waves entering the cavity 114. Sounds waves enter the cavity 114 through a sound inlet 116 formed through the substrate 106 at a front end of the transducer 102. The backplate 112 is a perforated structure that remains stationary as air moves through the perforations towards the back chamber 118. During operation, the movement of the diaphragm 110 relative to the backplate 112 in response to incoming acoustic pressure waves, or sound, creates a change in the amount of capacitance between the diaphragm 110 and the backplate 112. That creates an alternating output voltage which is sensed by the attached integrated circuit 106.

As shown in FIG. 1, the housing 108 blocks rear acoustic access to the diaphragm 110, which causes the MEMS microphone 100 to be inherently omnidirectional. More specifically, because sound waves can enter the transducer 102 through only the sound inlet 116 at the front of the transducer 102, the diaphragm 110 is able to react only to sound pressure within the front cavity 114, thus making the overall transducer 102 equally sensitive to sound sources positioned in any direction (e.g., front, back, left or right side). While omnidirectional microphones can be advantageous in certain applications, for example, where the target sound is coming from multiple directions, a directional, or more specifically, unidirectional, microphone may be preferred in other applications, such as, for example, when recording live performances that are associated with a lot of unwanted crowd or background noise.

FIG. 2 illustrates the general topology of a directional MEMS microphone 200 in accordance with embodiments. The directional MEMS microphone 200 includes a transducer assembly 201 similar to the conventional transducer assembly 101 shown in FIG. 1. In particular, the transducer assembly 201 includes a MEMS microphone transducer 202 similar to the transducer 102, an integrated circuit 204 similar to the integrated circuit 104, and a substrate 206 similar to the silicon substrate 106. Further, the MEMS transducer 202 includes a moveable diaphragm 210 disposed below a perforated backplate 212 and a front cavity 214 formed between the diaphragm 210 and a first sound inlet 216 formed through the substrate 206 at a front end of the transducer 202.

The transducer assembly 201 also includes a first enclosure 208, which may be a standard enclosure can for housing a MEMS transducer and is at least somewhat similar to the housing 108. For example, the MEMS transducer 202 and the integrated circuit 206 are both disposed within the first enclosure 208, as in FIG. 1, and the first enclosure 208 defines or forms a first acoustic volume 218 behind the MEMS transducer 202, similar to the back chamber 118 shown in FIG. 1. Unlike the back chamber 118, however, the first enclosure 208 includes an aperture 220 positioned adjacent to a rear end, or back side, of the MEMS transducer 202, opposite the first sound inlet 216, as shown in FIG. 2. The aperture 220 may be formed by punching or cutting a hole through a top surface of the first enclosure 208, or any other suitable means.

In embodiments, the aperture 220 is configured to at least partially open the back side of the transducer 202 to permit rear acoustic access to the diaphragm 210. This causes the diaphragm 210 of the MEMS transducer 202 to be partially open on two opposing sides (e.g., front and back sides), which creates an acoustic pressure differential across the diaphragm 210. For example, sound incident on the transducer assembly 201 along the 0 degree axis (e.g., traveling in the x direction) will first enter through the front sound inlet 216 and then through the aperture 220, after being delayed by the distance between the two openings 216 and 220. As will be appreciated, the sound wave entering the aperture 220 will be an attenuated (depending on a distance from the source) and phase-shifted version of the sound wave entering the first inlet 216. The resulting pressure gradient exerts a net force (e.g., front force minus back force) on the diaphragm 210 that causes it to move. Thus, the MEMS microphone 200 effectively operates as a "pressure gradient microphone."

The pressure difference between the front and back sides of the diaphragm 210 produces a directional response in the MEMS microphone 200. For example, in some embodiments, the MEMS microphone 200 may be equally sensitive to sounds arriving from the front or back of the transducer 202, but insensitive to sounds arriving from the side (e.g., bi-directional). In a preferred embodiment, the MEMS microphone 200 is configured to be unidirectional, or primarily sensitive to sounds from only one direction (e.g., a front side). In such cases, the MEMS microphone 200 can be configured to have any first order directional polar pattern (such as, e.g., cardioid, hypercardioid, supercardioid, or subcardioid) by obtaining the appropriate combination of pressure and pressure-gradient effects. This may be achieved, for example, by adjusting an internal volume of air within the MEMS microphone 200 (e.g., through addition of secondary enclosure 222) and/or configuring an acoustic resistance value thereof (e.g., through addition of acoustic resistance 228).

More specifically, one property for adjusting the volume within the MEMS microphone 200 is the distance between the front and back sound inlets, which scales linearly with the net force on the diaphragm 210. As will be appreciated, in order to establish a pressure gradient, the distance between sound inlets must be at least large enough to establish a net force that can be detected above any system noise, including acoustical self-noise of the MEMS transducer 202. In some cases, the distance between the first sound inlet 216 and the aperture 220 is predetermined by the manufacturer of the transducer assembly 201, and this predetermined distance (e.g., approximately 2 millimeters (mm)) is not large enough to be detectable above the noise floor of the electrical/mechanical components of the overall microphone system.

In embodiments, an improved directional microphone response may be achieved by increasing the distance between the front and back sound inlets until the pressure gradient is maximized, or substantially increased, over a bandwidth of interest. To help achieve this result, the transducer assembly 201 further includes a second enclosure 222 that is disposed adjacent to, or attached to, an exterior of the first enclosure 208 and defines a second acoustic volume 224 behind the first enclosure 208 and the first acoustic volume 218 formed therein. The second enclosure 222 may be an enclosure can or housing similar to the first enclosure 208 and may be stacked on top of the first enclosure 208, as shown in FIG. 2. According to embodiments, the aperture 220 in the back end of the first enclosure 208 facilitates acoustic communication between the first acoustic volume 218 and the second acoustic volume 224, thereby increasing a total acoustic volume of the transducer assembly 201. Moreover, as shown in FIG. 2, a back end or wall of the second enclosure 222 includes a second sound inlet 226 that is positioned opposite the aperture 220 for allowing rear access to the diaphragm 210 through the second enclosure 222. According to embodiments, the second sound inlet 226 operates as the back sound inlet for the microphone 200. For example, the net force on the diaphragm 210 can be a function of the distance between the first or front sound inlet 216 and the second sound inlet 226. As shown in FIG. 2, the second inlet 226 may be substantially aligned with the aperture 220 and/or the first sound inlet 216 to further facilitate rear access to the diaphragm 210.

In embodiments, the second inlet 226 can be positioned a predetermined distance, D, from the first inlet 216, and this predetermined distance (also referred to as "front-to-back distance") can be selected to create a pressure gradient across the diaphragm 210. As shown in FIG. 2, the front-to-back distance of the microphone 200 is substantially equal to a height of the first enclosure 208 plus a height of the second enclosure 222. In some embodiments, the height of the first enclosure 208 remains fixed, while the height of the second enclosure 222 is selected so that the distance, D, from front to back of the microphone 200 is sufficient to maximize, or substantially increase, the pressure gradient across the diaphragm 210. For example, in embodiments, the front-to-back distance, D, of the microphone 200 is increased to approximately 7 millimeters (mm) by configuring the second enclosure 222 to have a height of 5 mm. In other embodiments, a height of the first enclosure 208 may be adjusted as well to achieve an increase in the overall distance from front to back of the microphone 200.

Increasing the front-to-back distance D of the microphone 200 can cause an increase in the external acoustic delay d1 (also referred to as a "sound delay"), or the time it takes for a sound pressure wave to travel from the front end of the microphone 200 (e.g., the first sound inlet 216) to the back end of the microphone 200 (e.g., the second sound inlet 226). As will be appreciated, the sound wave incident on the back end of the microphone 200 will differ only in phase from the sound wave incident on the front end, assuming a planar sound wave and that a distance between the microphone 200 and the sound source is sufficiently large enough to produce a negligible pressure drop from front to back of the microphone 200.

In embodiments, the second enclosure 222 is further configured to help introduce an internal acoustic delay, d2, (also referred to herein as a "network delay") capable of establishing a first order directional polar pattern (such as, e.g., cardioid, hypercardioid, supercardioid, or subcardioid) for the microphone 200. To achieve this result, the second enclosure 222 can include, all or portion(s) of, an acoustical delay network (also referred to as a "phase delay network") configured to modify the propagation of sound to the second sound inlet 226 at the back end of the microphone 200 and create a first order polar pattern with a directional preference towards the first sound inlet 216 at the front end of the microphone 200. For example, in embodiments, the acoustical delay network is formed by an overall cavity compliance, $C_{total}$, of the MEMS microphone 200, or a sum of the first acoustic volume 218 inside the first enclosure 208 and the second acoustic volume 224 inside the second enclosure 222, and an acoustic resistance 228 with a predetermined acoustic resistance value, R, placed adjacent to the second inlet 226. The acoustic resistance 228 may be a fabric, screen, or other suitable material that is attached to the second enclosure 222 so as to cover the second inlet 226, and is configured to create the acoustic flow resistance, R, at the second sound inlet 226. During operation, sound waves impinging on the diaphragm 210 through the first sound inlet 216 will also propagate to and through the second sound inlet 226 at the back end of the microphone 200, passing through the acoustic delay network, including the acoustic resistance 228, before reaching the rear of the diaphragm 210.

In embodiments, the mechanical properties of the second enclosure 222, including the second acoustic volume 224 formed thereby and the acoustic resistance 228 included thereon, can largely determine a value of the acoustic network delay d2. For example, in one embodiment, the acoustic network delay, d2, is approximated to be substantially equal to a product of the acoustic resistance, R, and the cavity compliance, $C_{total}$. Further, in some cases, the overall cavity compliance $C_{total}$ is primarily a function of the second acoustic volume 224 formed by the second enclosure 222 because the second acoustic volume 224 is significantly larger than the first acoustic volume 218. As will be appreciated, a directional microphone response may be achieved by configuring the acoustic network delay d2 to counter the external acoustic delay d1 and create a phase shift for cancelling the sound waves approaching from the direction in which the pressure gradient approaches a null (or zero). Accordingly, in embodiments, values for the acoustic resistance R and cavity compliance $C_{total}$ of the MEMS microphone 200 can be appropriately selected so that the time delay resulting from the acoustic network delay, d2, is substantially equal to the time delay resulting from the external acoustic delay, d1, wherein the external delay d1 is approximately equal to the front-to-back distance, D, of the microphone 200 divided by the speed of sound ("c").

Thus, the techniques described herein provide a directional MEMS microphone 200 with an acoustic delay network that is external to, or not part of, the MEMS transducer assembly 201, as shown in FIG. 2. This configuration provides increased design flexibility for the MEMS microphone 200, since the second enclosure 222 can be tailored to specific applications or polar patterns without altering the underlying transducer assembly 201. It should be appreciated that while exemplary implementations of the acoustic delay network have been described herein, other implementations are also contemplated in accordance with the techniques described herein.

Figure 6:
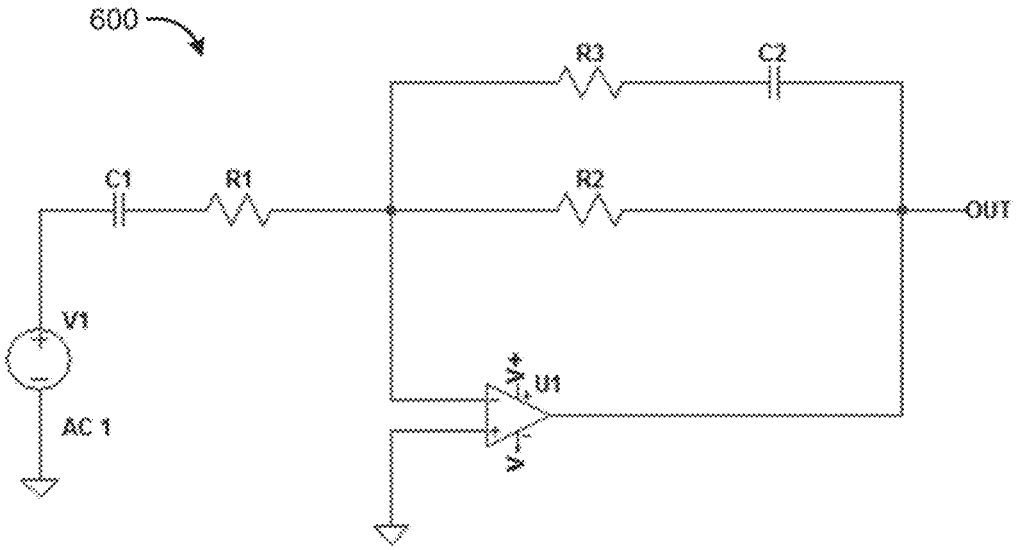
FIG. 6 is a circuit diagram of the exemplary shelving filter of FIG. 5, in accordance with embodiments.
Figure 7:
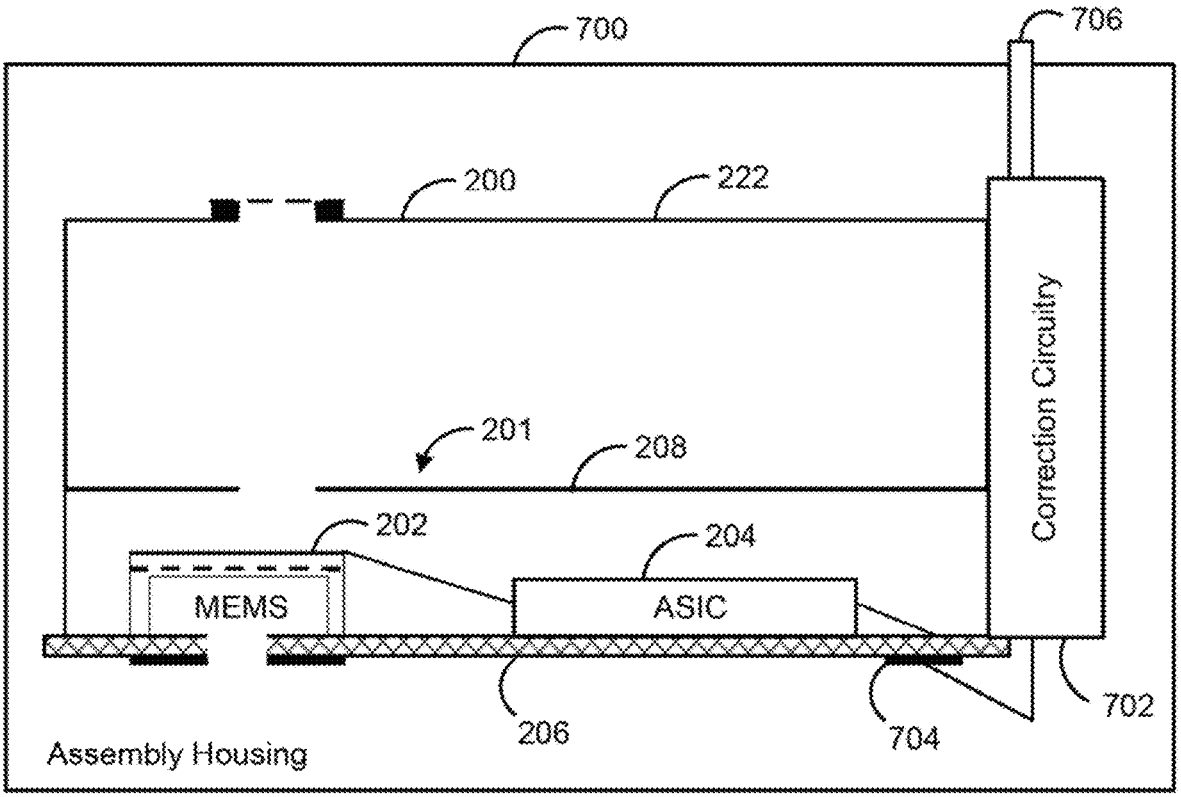
FIG. 7 is a schematic diagram of a microphone assembly housing comprising the directional MEMS microphone shown in FIG. 2 and correction circuitry coupled to the microphone, in accordance with one or more embodiments.
Figure 8:
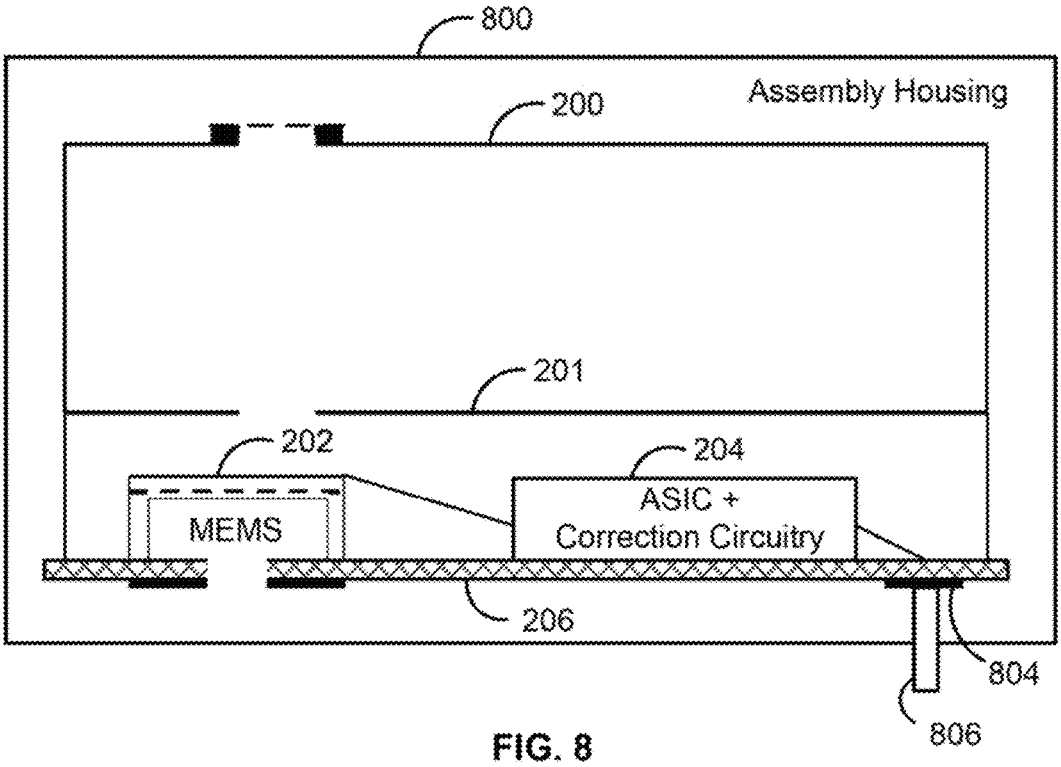
FIG. 8 is a schematic diagram of a microphone assembly housing comprising the directional MEMS microphone shown in FIG. 2 and correction circuitry integrated within the microphone, in accordance with one or more embodiments.
Figure 9:
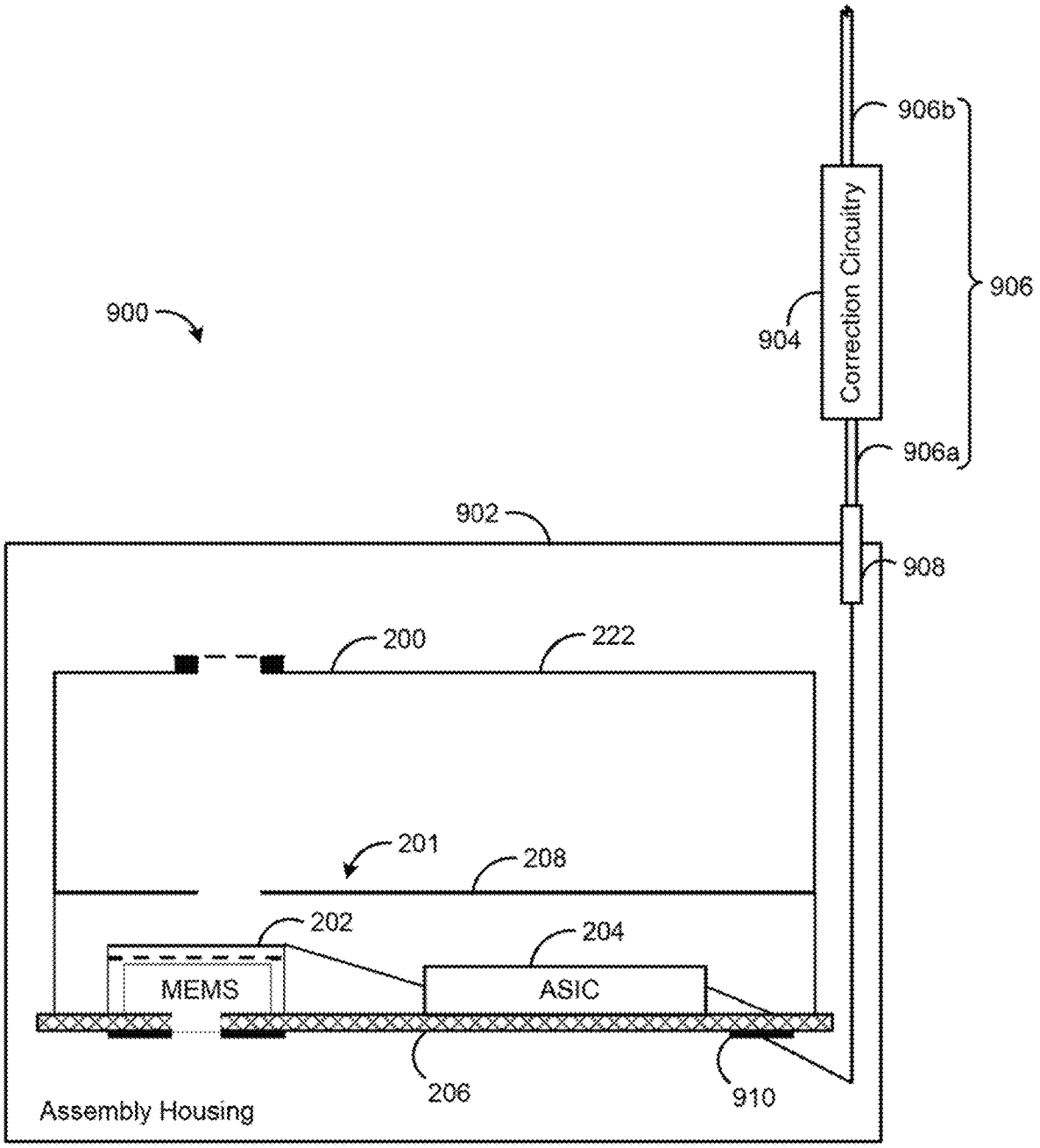
FIG. 9 is a schematic diagram of a microphone assembly housing comprising the directional MEMS microphone shown in FIG. 2 and correction circuitry included on a cable coupled to the microphone assembly housing, in accordance with one or more embodiments.

In embodiments, the pressure gradient response of the directional MEMS microphone 200 rises at a rate of 6 decibels (dB) per octave but flattens out at higher frequencies due to a low pass filter effect produced by the acoustical delay network. In other words, the microphone 200 has a high end response, but no bass or mid section responses. As an example, the acoustical delay network created upon adding the second enclosure 222 to the transducer assembly 201 may behave like a first order low pass filter with a frequency response that begins to flatten out around 10 kHz and has a corner frequency or knee (e.g., a −3 dB down point) at 7.8 kilohertz (kHz), assuming a front-to-back distance of 7 mm as discussed above (see, e.g., response plot 302 shown in FIG. 3). This frequency response may not be acceptable for certain applications, such as, for example, live or stage performances and other wideband audio applications where the microphone transducer is expected to reproduce substantially the entire audio bandwidth (e.g., 20 hertz (Hz)≤f≤20 kilohertz (kHz)). Accordingly, the techniques described herein further provide correction circuitry configured to produce a flattened frequency response for the directional MEMS microphone 200 across at least a substantial portion of the bandwidth of interest (see e.g., corrected response plot 304 in FIG. 3 and corrected response plot 404 in FIG. 4). The correction circuit can be constructed of op-amp technology (e.g., as shown in FIG. 6) and can be attached to the MEMS microphone 200 (e.g., as shown in FIG. 7), integrated into the MEMS microphone 200 (e.g., as shown in FIG. 8), or included on a cable coupled to the microphone assembly housing (e.g., as shown in FIG. 9), as will be discussed in more detail below.

Figure 3:
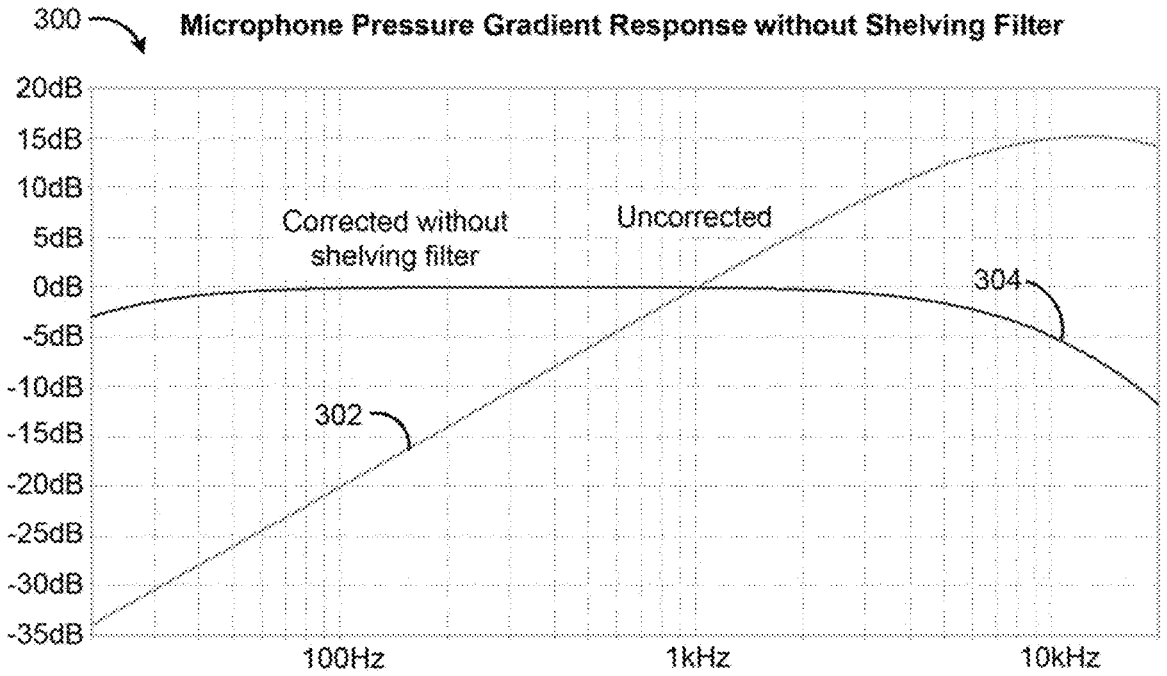
FIG. 3 is an exemplary frequency response plot of the directional MEMS microphone shown in FIG. 2 and a first corrected response due to a first correction circuit, in accordance with embodiments.

Referring now to FIG. 3, shown is an exemplary frequency versus sound pressure graph 300 for the MEMS microphone 200, in accordance with embodiments. The graph 300 includes a first response plot 302 (also referred to herein as "uncorrected response plot") representing the original frequency response of the directional MEMS microphone 200, without any correction or equalization effects. As shown, the uncorrected response plot 302 begins to flatten out above a first predetermined frequency (e.g., around 10 kHz) and has a corner frequency or knee (e.g., a −3 dB down point) at a second predetermined frequency (e.g., 7.8 kilohertz (kHz)). The graph 300 further includes a second response plot 304 (also referred to herein as "corrected response plot") representing a corrected frequency response of the directional MEMS microphone 200 after being conditioned or equalized by a first correction circuit. In embodiments, the first exemplary correction circuit (not shown) may include a passive low pass filter with a corner frequency that is low enough to cover the entire bandwidth of interest for the MEMS microphone 200 (e.g., 20 Hz to 20 kHz). Because the low pass filter is applied across the entire bandwidth of interest, the corrected microphone response becomes attenuated at higher frequencies, as shown by plot 304 in FIG. 3. This may be less desirable at least because the frequency response of the MEMS microphone 200 is already at least partially attenuated above certain higher frequencies (e.g., 10 kHz) due to the addition of the acoustic delay network.

Figure 4:
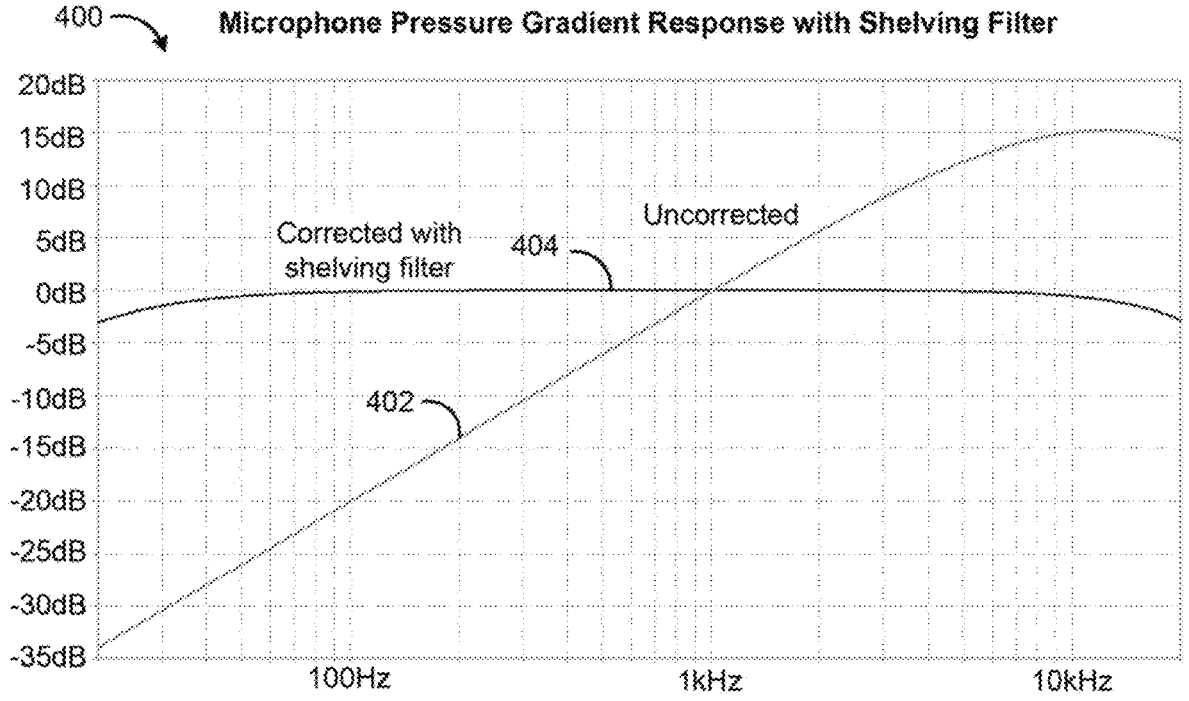
FIG. 4 is an exemplary frequency response plot of the directional MEMS microphone shown in FIG. 2 and a second corrected response due to a second correction circuit, in accordance with embodiments.

FIG. 4 illustrates another exemplary frequency versus sound pressure graph 400 for the MEMS microphone 200, in accordance with embodiments. The graph 400 includes a first response plot 402 (also referred to herein as "uncorrected response plot") representing an original frequency response of the directional MEMS microphone 200, without any correction or equalization effects. Like the plot 302 shown in FIG. 3, the uncorrected response plot 402 begins to flatten out above a first predetermined frequency (e.g., around 10 kHz) and has a corner frequency or knee (e.g., a −3 dB down point) at a second predetermined frequency (e.g., 7.8 kilohertz (kHz)). The graph 400 further includes a second response plot 404 (also referred to herein as "corrected response plot") representing a corrected frequency response of the directional MEMS microphone 200 after being conditioned or equalized by a second correction circuit. According to embodiments, the second correction circuit includes an active shelving filter configured to correct a selected portion of the frequency response of the MEMS microphone 200. For example, the active shelving filter may be configured to equalize a non-flat portion of the microphone response 402 (e.g., the 6 dB per octave rise until the corner frequency knee at 7.8 kHz), and leave unaffected a flattened portion of the response 402 (e.g., above 10 kHz).

Figure 5:
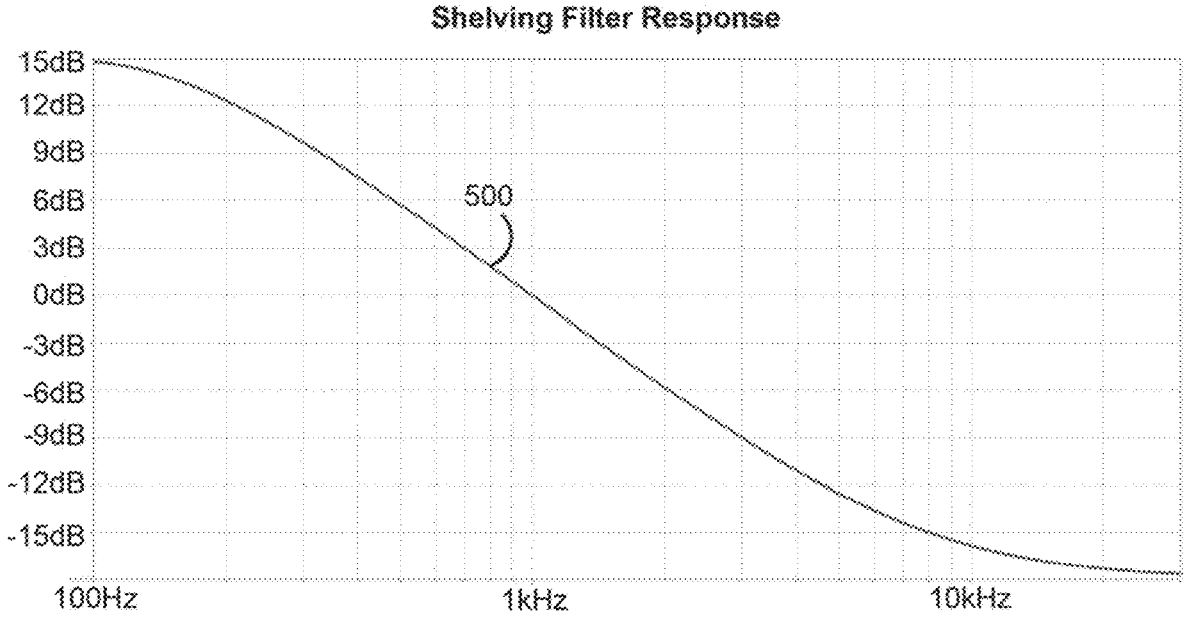
FIG. 5 is a frequency response plot of an exemplary shelving filter included in the second correction circuit of FIG. 4, in accordance with embodiments.

FIG. 5 is a response plot 500 of an example active shelving filter for correcting a portion of the frequency response of the MEMS microphone 200, in accordance with embodiments. As shown, the response plot 500 (also referred to herein as "shelving filter plot") decreases until reaching a predetermined high frequency value (e.g., 10 kHz), after which the frequency response of the filter flattens out. In embodiments, this shape of the shelving filter plot 500 is attributable to at least three corner frequencies of interest associated with the shelving filter. The first corner frequency is adjacent to a left side of the plot 500 and acts as a high pass filter for controlling the low frequency response, or "extension." A second corner frequency occurs before the −6 dB/octave correction curve begins, and the third corner frequency occurs just as the −6 dB/octave correction curve ends, or where the correction stops working in order to allow the high frequency output to pass unaffected. According to embodiments, the corrected frequency plot 404 shown in FIG. 4 is the result of combining the shelving filter plot 500 of FIG. 5 and the uncorrected response plot 402 of FIG. 4. As shown in FIG. 4, the corrected response plot 404 is flat for a majority portion of the frequency response (e.g., between the second and third corner frequencies of the shelving filter), with attenuation occurring only after 10 kHz (e.g., after the third corner frequency).

FIG. 6 illustrates an exemplary circuit 600 for implementing an analog version of the shelving filter for correcting or flattening out a portion of the frequency response of the MEMS microphone 200, in accordance with embodiments. As shown, the circuit 600 may be constructed using operational amplifier ("op-amp") technology to achieve the analog version of the active shelving filter. It should be appreciated that the depicted circuit is one example for implementing the shelving filter and other implementations are contemplated in accordance with the techniques described herein.

In some embodiments, the shelving filter may be implemented using a digital signal processor, one or more analog components, and/or a combination thereof. For example, in general, a shelving filter may be represented by a mathematical transfer function such as Equation 1, wherein the denominator describes the low frequency pole location, and the numerator describes the high frequency zero and shelving location.

$$H(\omega) = A\frac{1 + j\frac{\omega}{\omega_1}}{1 + j\frac{\omega}{\omega_2}}, \text{ such that } \omega_1 > \omega_2 \qquad \text{Equation 1}$$

Applying Equation 1 to circuit 600 of FIG. 6, the high frequency zero (shelf) may be obtained using Equation 2, while the low frequency pole may be obtained using Equation 3.

$$f_H = \frac{1}{2\pi R_3 C_2} \qquad \text{Equation 2}$$

$$f_l = \frac{1}{2\pi(R_2 + R_3)C_2} \qquad \text{Equation 3}$$

Assuming that a capacitance value for capacitor C1 of circuit 600 is sufficiently large, such that its impedance does not factor into the shelving function, the circuit transfer function for the shelving portion may be represented by Equation 4.

$$\frac{V_o(\omega)}{V_i(\omega)} = \left(\frac{R_2}{R_1}\right)\frac{1 + j\omega R_3 C_2}{1 + j\omega(R_2 + R_3)C_2} \qquad \text{Equation 4}$$

In some cases, Equation 4 may be used to implement a digital version of the shelving filter, for example, on a digital signal processor. In other cases, Equation 4 may be used to implement the circuit 600 shown in FIG. 6. It should be appreciated that the shelving filter equations provided herein are exemplary and other implementations are contemplated in accordance with the techniques described herein.

Referring now to FIG. 7, shown is an exemplary assembly housing 700 (also referred to herein as "microphone assembly") comprising correction circuitry 702 for producing a flattened frequency response for the directional MEMS microphone 200 of FIG. 2, in accordance with embodiments. As illustrated, the housing 700 includes the MEMS microphone 200 and correction circuitry 702 operatively coupled thereto. As shown in FIG. 7, the correction circuitry 702 can be electrically connected to the integrated circuit 204 included within the transducer assembly 201 of the microphone 700. This electrical connection may be made via a solder pad 204 provided on an external surface of the substrate 206, wherein the integrated circuit 204 is also electrically coupled to the solder pad 204 via the substrate 206.

As shown in FIG. 7, the correction circuitry 702 can be coupled outside the MEMS microphone 200, but within the overall assembly housing 700. According to embodiments, the correction circuitry 702 can be mechanically attached to one or more of an exterior of the transducer assembly 201 and an exterior of the second enclosure 222. In the illustrated embodiment, the correction circuitry 702 is coupled along one side of the microphone 200, adjacent to both the first enclosure 208 and the second enclosure 222. In other embodiments, the correction circuitry 702 can be located elsewhere within the assembly housing 700, as long as the correction circuitry 702 remains electrically coupled to the integrated circuit 204. This configuration (e.g., placing the correction circuitry 702 completely outside of the MEMS microphone 200 and coupling the two through an external connection) allows the correction circuitry 702 to be added to any pre-existing MEMS microphone, including, for example, a conventional MEMS microphone unit (e.g., MEMS microphone 100 of FIG. 1) or other MEMS microphone designs. This configuration also enables the MEMS microphone 200 to be altered independently of the correction circuitry 702, and vice versa, thus reducing the complexity of the overall microphone design.

In embodiments, the correction circuitry 702 includes a printed circuit board (PCB) coupled to one or more analog devices configured to produce a desired frequency response (such as, e.g., correction circuit 600 shown in FIG. 6). The correction circuitry 702 can be configured such that no other interface or circuitry outside the assembly housing 700 is required to obtain the desired response. For example, all necessary equalization circuitry may be included on the correction circuit 702 inside the assembly housing 700. In a preferred embodiment, the correction circuitry 702 includes an active shelving filter configured to correct a selected portion of a frequency response of the MEMS microphone 200. In some embodiments, the active shelving filter is constructed using op-amp technology, such as, for example, circuit 600 of FIG. 6.

As shown in FIG. 7, the housing 700 further includes a connection port 706 configured to receive a cable for operatively connecting the microphone assembly housing 700 to an external device (e.g., a receiver, etc.). In some embodiments, the connection port 706 is a standard audio input port configured to receive a standard audio plug connected to the cable. As shown, the connection port 706 may be connected to the correction circuitry 702, such that audio signals captured by the microphone 200 are modified by the correction circuitry 702 before exiting the microphone assembly housing 700 via the port 706.

FIG. 8 depicts another exemplary assembly housing 800 (also referred to herein as "microphone assembly") comprising the directional MEMS microphone 200 of FIG. 2 and correction circuitry configured to correct a frequency response of the microphone 200, in accordance with embodiments. The correction circuitry of FIG. 8 may be functionally similar to the correction circuitry 702 described above and shown in FIG. 7, but physically different in terms of its structural makeup. For example, in the illustrated embodiment, the correction circuitry is included within the integrated circuit 204 (e.g., ASIC), such that no external circuitry or separate PCB is required outside of the transducer assembly 201. In a preferred embodiment, the correction circuitry of the integrated circuit 204 includes an active shelving filter configured to correct a selected portion of a frequency response of the MEMS microphone 200, as described herein and with respect to FIG. 7. As will be appreciated, this configuration significantly reduces an overall size of the microphone assembly housing 800, as well as the overall complexity of the microphone design.

As shown in FIG. 8, the assembly housing 800 further includes a connection port 806 electrically coupled to the integrated circuit 204 via a solder pad 804. Like the connection port 706 shown in FIG. 7, the connection port 806 can be configured to receive a cable for operatively coupling the microphone 200 to an external device (e.g., receiver, etc.). For example, the port 806 may be a standard audio input port configured to receive a standard audio plug attached to one end of the cable. Also like the connection port 706, the audio signals exiting the microphone assembly housing 800 via the connection port 806 have already been modified by the correction circuitry within the housing 800.

FIG. 9 depicts an exemplary microphone system 900 comprising an assembly housing 902 (also referred to herein as "microphone assembly"), which houses the directional MEMS microphone 200 of FIG. 2, correction circuitry 904 configured to correct a frequency response of the microphone 200, and a cable 906, in accordance with embodiments. The correction circuitry 904 may be similar to the correction circuitry 702 described above and shown in FIG. 7. For example, in a preferred embodiment, the correction circuitry 904 includes an active shelving filter configured to correct a selected portion of a frequency response of the MEMS microphone 200, as described herein and with respect to FIG. 7. Unlike the correction circuitry 702, however, the correction circuitry 904 is located outside of the microphone assembly housing 900 and is operatively coupled to the microphone assembly housing 902 via the cable 906.

As shown in FIG. 9, the cable 906 is coupled to a connection port 908 included in the assembly housing 902. In embodiments, the connection port 908 can be similar to the connection ports 706 and 806, as shown in FIGS. 7 and 8, respectively, and described herein. For example, the connection port 908 may be a standard audio input port configured to receive a standard audio plug connected to a first end of the cable 906. Examples of suitable connection ports include, but are not limited to, an XLR connector (e.g., XLR3, XLR4, XLR5, etc.), a mini XLR connector (e.g., TA4F, MTQG, or other mini 4-pin connectors), a ⅛" or 3.5 mm connector (e.g., a TRS connector, or the like), and a low voltage or coaxial connector (e.g., unipole or multipole connectors manufactured by LEMO, or the like). As shown in FIG. 9, the connection port 908 can be electrically connected to the integrated circuit 204 of the microphone 200 via a solder pad 910 that is provided on an external surface of the substrate 206 of the microphone 200. An electrical connection may be formed between the solder pad 910 and the integrated circuit 204 through the substrate 206.

In embodiments, the correction circuitry 904 can be included on a printed circuit board (not shown) that is included on the cable 906 or otherwise coupled to the cable 906. The printed circuit board may be a rigid or flexible board. As an example, an input of the correction circuitry 904 may be coupled to a first section **906*a* of the cable 906 positioned between the assembly housing 900 and the correction circuitry 904, and an output of the correction circuitry 904 may be coupled to a second section 906*b* of the cable 906 positioned on the opposing side of the correction circuitry 904, as shown in FIG. 9. In such cases, a first end of the cable 906 can be coupled to the connection port 908, as shown, and a second end (not shown) of the cable 906 can be coupled to an external device (not shown). Thus, audio signals captured by the microphone 200 can be modified by the correction circuitry 904 included on the cable 906 after exiting the assembly housing 902, via the connection port 908, but before proceeding to the external device (e.g., receiver) coupled to the second end of the cable 906**.

In embodiments, the cable 906 is a standard audio cable capable of transporting audio signals and/or control signals between the assembly housing 902 and the external device. In some embodiments, the cable 906 is physically separated into two sections **906*a* and 906*b* that are electrically connected to each other via or through the correction circuitry 904. In other embodiments, the cable 906 is a continuous cable and the correction circuitry 904 is electrically coupled to the cable 906 using a parallel connection. In one example embodiment, the correction circuitry 904 is encased in a housing (e.g., a plastic case) that is coupled to the cable 906. By placing the correction circuitry on the cable 906 and outside of the assembly housing 902, an overall size and complexity of the microphone assembly 902 can be minimized or reduced, and the correction circuitry 904 is made more easily accessible for fine-tuning, servicing, and/or replacement, as needed. Placing the correction circuitry 904 on the cable 906 also creates the option of removing the correction circuitry 904 altogether, for example, in cases where the microphone assembly already includes its own correction circuitry (e.g., as shown in FIGS. 7 and 8**) or where the MEMS microphone does not require additional correction.

Thus, the techniques described herein provide a directional MEMS microphone that includes a second enclosure can or housing behind the native enclosure can of the transducer assembly and apertures within a rear wall of both enclosures, so as to acoustically connect a first acoustic volume defined by the native enclosure can and a second acoustic volume defined by the second enclosure can. The first and second acoustic volumes, in cooperation with an acoustic resistance disposed over the rear sound inlet formed through the second enclosure, are configured to create an acoustic delay for producing the directional polar pattern of the MEMS microphone.

The techniques described herein also provide for producing a directional MEMS microphone with a frequency response that is appropriate for wideband audio applications. The frequency response of the microphone can be modified using correction circuitry that includes a shelving filter for correcting a relevant portion of the microphone response. For example, the shelving filter may be configured to modify only the non-flat portions of the frequency response, so that the high frequency portion passes through unaffected. In embodiments, the correction circuitry may be embedded within the integrated circuit of the MEMS microphone transducer, attached to an exterior of the transducer assembly, or included on a cable coupled to the microphone assembly housing.

This disclosure is intended to explain how to fashion and use various embodiments in accordance with the technology rather than to limit the true, intended, and fair scope and spirit thereof. The foregoing description is not intended to be exhaustive or to be limited to the precise forms disclosed. Modifications or variations are possible in light of the above teachings. The embodiment(s) were chosen and described to provide the best illustration of the principle of the described technology and its practical application, and to enable one of ordinary skill in the art to utilize the technology in various embodiments and with various modifications as are suited to the particular use contemplated. All such modifications and variations are within the scope of the embodiments as determined by the appended claims, as may be amended during the pendency of this application for patent, and all equivalents thereof, when interpreted in accordance with the breadth to which they are fairly, legally and equitably entitled.

What is claimed is:

1. A microphone assembly, comprising:

a transducer assembly including a first enclosure defining a first acoustic volume and a Micro-Electrical-Mechanical-System ("MEMS") microphone transducer disposed within the first enclosure such that the first acoustic volume surrounds a rear of the MEMS microphone transducer;

a second enclosure disposed adjacent to the first enclosure and defining a second acoustic volume in acoustic communication with the first acoustic volume, the second enclosure including an acoustic resistance, wherein the first and second acoustic volumes, in cooperation with the acoustic resistance, create an acoustic delay for producing a directional polar pattern; and circuitry electrically coupled to the transducer assembly and comprising a shelving filter configured to correct a portion of a frequency response of the MEMS microphone transducer, so as to flatten the frequency response across all frequency values within a predetermined bandwidth.

2. The microphone assembly of claim 1, wherein the circuitry is mechanically attached to an exterior of the transducer assembly.

3. The microphone assembly of claim 1, wherein the circuitry is mechanically attached to an exterior of the second enclosure.

4. The microphone assembly of claim 1, wherein the directional polar pattern is a first order directional polar pattern.

5. The microphone assembly of claim 1, wherein the transducer assembly further includes an integrated circuit electrically coupled to the MEMS microphone transducer and disposed within the first enclosure, the circuitry being electrically connected to the integrated circuit of the transducer assembly.

6. The microphone assembly of claim 1, wherein the first enclosure includes an aperture to facilitate acoustic communication between the first acoustic volume and the second acoustic volume, the aperture being positioned adjacent to the MEMS microphone transducer.

7. The microphone assembly of claim 6, wherein the first enclosure includes a first sound inlet positioned adjacent to the MEMS microphone transducer, and the second enclosure includes a second sound inlet positioned a predetermined distance from the first sound inlet.

8. The microphone assembly of claim 7, wherein the predetermined distance is selected to create a pressure gradient across a diaphragm of the MEMS microphone transducer.

9. The microphone assembly of claim 7, wherein the acoustic resistance covers the second sound inlet.

10. The microphone assembly of claim 1, further comprising a connection port electrically coupled to the circuitry and configured to receive a cable for operatively coupling the transducer assembly to an external device.

11. The microphone assembly of claim 1, further comprising a substrate configured to support the transducer assembly.

12. A microphone assembly, comprising:

a transducer assembly including a Micro-Electrical-Mechanical-System ("MEMS") microphone transducer, an integrated circuit electrically coupled to the MEMS microphone transducer, and a first enclosure defining a first acoustic volume and having disposed therein the integrated circuit and the MEMS microphone transducer, such that the first acoustic volume surrounds a rear of the MEMS microphone transducer; and a second enclosure disposed adjacent to the first enclosure and defining a second acoustic volume in acoustic communication with the first acoustic volume, the second enclosure including an acoustic resistance, and the first and second acoustic volumes creating an acoustic delay to produce a directional polar pattern, wherein the integrated circuit includes circuitry comprising a shelving filter configured to correct a portion of a frequency response of the MEMS microphone transducer, so as to flatten the frequency response across all frequency values within a predetermined bandwidth.

13. The microphone assembly of claim 12, wherein the integrated circuit is an Application Specific Integrated Circuit (ASIC).

14. The microphone assembly of claim 12, wherein the directional polar pattern is a first order directional polar pattern.

15. The microphone assembly of claim 12, wherein the second enclosure includes an aperture to facilitate acoustic communication between the first acoustic volume and the second acoustic volume, the aperture being positioned adjacent to the MEMS microphone transducer.

16. The microphone assembly of claim 12, wherein the first enclosure includes a first sound inlet positioned adjacent to the MEMS microphone transducer, and the second enclosure includes a second sound inlet positioned a predetermined distance from the first sound inlet.

17. The microphone assembly of claim 16, wherein the predetermined distance is selected to create a pressure gradient across a diaphragm of the MEMS microphone transducer.

18. The microphone assembly of claim 16, wherein the acoustic resistance covers the second sound inlet.

19. The microphone assembly of claim 12, further comprising a connection port electrically coupled to the integrated circuit and configured to receive a cable for operatively coupling the transducer assembly to an external device.

20. The microphone assembly of claim 12, further comprising a substrate configured to support the transducer assembly.

* * * * *